US006642833B2

(12) United States Patent
Ranjan et al.

(10) Patent No.: US 6,642,833 B2
(45) Date of Patent: Nov. 4, 2003

(54) HIGH-VOLTAGE CURRENT-LIMITING FUSE

(75) Inventors: Radhakrishnan Ranjan, Hickory, NC (US); Eli Valle, Ceiba, PR (US); Constance Moore Dotson, Cherryville, NC (US); Arthur Thomas Ehmke, Vieques, PR (US); Cesar Eliut Lopez, Vieques, PR (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/771,048

(22) Filed: Jan. 26, 2001

(65) Prior Publication Data

US 2002/0101323 A1 Aug. 1, 2002

(51) Int. Cl.[7] ..... H01H 85/175; H01H 85/193

(52) U.S. Cl. ..... 337/231; 337/228; 337/248; 337/251; 337/252; 29/623

(58) Field of Search ..... 337/158, 159, 337/165, 186, 187, 228, 231, 248, 251, 252, 260, 273, 276, 297; 29/623

(56) References Cited

U.S. PATENT DOCUMENTS

| | | | | |
|---|---|---|---|---|
| 1,213,777 A | | 1/1917 | Roberts | |
| 2,772,334 A | | 11/1956 | Latour | 200/144 |
| 3,166,656 A | | 1/1965 | Hollmann et al. | 200/120 |
| 3,838,375 A | | 9/1974 | Frind et al. | 337/276 |
| 3,967,228 A | | 6/1976 | Koch et al. | 337/248 |
| 4,028,655 A | | 6/1977 | Koch | 337/160 |
| 4,057,775 A | * | 11/1977 | Biller | 337/186 |
| 4,260,976 A | * | 4/1981 | Miller | 337/162 |
| 4,388,603 A | * | 6/1983 | Hassler et al. | 337/158 |
| 4,413,246 A | * | 11/1983 | Westrom et al. | 337/159 |
| 4,506,249 A | | 3/1985 | Huber et al. | 337/232 |
| 4,544,908 A | | 10/1985 | Blewitt et al. | 337/279 |
| 4,686,502 A | | 8/1987 | Parker et al. | 337/252 |
| 4,771,259 A | * | 9/1988 | Gaia et al. | 337/163 |
| 4,951,026 A | * | 8/1990 | Ehlmann | 337/231 |
| 5,003,281 A | * | 3/1991 | Reese | 337/232 |
| 5,485,136 A | * | 1/1996 | Johnson et al. | 337/168 |
| 5,604,474 A | * | 2/1997 | Leach et al. | 337/158 |
| 5,670,926 A | | 9/1997 | Ranjan et al. | 337/158 |
| 5,736,919 A | * | 4/1998 | Reeder | 337/206 |

FOREIGN PATENT DOCUMENTS

| | | | | |
|---|---|---|---|---|
| GB | 2233840 A | * | 1/1991 | H01H/85/143 |

* cited by examiner

*Primary Examiner*—Anatoly Vortman
(74) *Attorney, Agent, or Firm*—Cantor Colburn LLP

(57) ABSTRACT

A high-voltage current-limiting fuse comprises an elongated housing, an auto-centering connector centrally located about the elongated axis of the housing, and an elongated fusible element attached to the connector and secured along the elongated axis of the housing by the connector. The auto-centering connector is located about the elongated axis of the housing by a surface near one end of the housing, and the elongated conductive fusible element is connected to the connector and contained within the housing. The auto-centering connector is connected to an end of the fusible element, and mechanically located but electrically insulated relative to the housing.

21 Claims, 4 Drawing Sheets

HIGH-VOLTAGE CURRENT-LIMITING FUSE

BACKGROUND OF THE INVENTION

This invention relates generally to current-limiting fuses. More particularly, this invention relates to connectors for current-limiting fuses suitable for use in high-voltage applications.

Over-current protection may be provided by fuses as well as by circuit breakers, switches, relays and other devices. Each type of equipment has variations in ratings, service requirements and costs. Fuses generally present the most cost-effective means for providing automatic high-voltage current protection against a single over-current failure. Most types of fuses are designed to minimize damage to conductors and insulation from excessive current.

High voltage current-limiting fuses are used in a variety of applications. The basic fuse construction consists of a fusible element, a core to support this element, filler for enhancing the interruption of fault current at high voltages, and a housing to house the above components. There are provisions to connect the fuse to an external electric circuit, typically located at each end of the fuse. The fuse housing materials may consist of glass, ceramic, porcelain, and glass-filament-wound epoxy tubing. Copper ferrules or sand cast caps are typically glued to the ends of the fuse body with an epoxy or pressed onto the fuse housing with an interference fit to form end enclosures.

Fuses protect against over-currents in electrical equipment. The current path within a typical fuse is through the end caps or ferrules to a metallic fusible element. The resistance of the fusible element develops heat that causes a portion of the metal to melt or disintegrate upon reaching the melting temperature of the metal. This property is exploited to achieve accurate thermal activation of a fuse in response to a particular level of overload current. The thermal activation exhibits an inverse-time response curve. In other words, a small overload generally takes a longer time to heat the metal and melt the fuse. As the overload current increases, the heating and melting time is reduced.

The physical length of a high-voltage fuse with a fusible element of a given length is reduced by winding the element spirally around a core. In order to impede arcing in high-voltage applications, a non-conductive filler material is typically used to fill the voids between conductive portions of the fuse to quench the arcing.

A typical high-voltage current-limiting fuse comprises a tubular insulating housing, an elongated core within the housing, and one or more fusible elements wound about the core and connected between terminals at opposite ends of the housing. A core is needed in fuses rated at 5 kilovolts ("kV") and above in order to enable the fuse to accommodate the required length of fusible element within a housing of practical length. Typical housing lengths range from 8 to 38 inches for voltages up to about 46 kV. By winding the fusible elements about the core, preferably in a generally helical path, fuses having fusible elements of a length much greater than the length of the core can be produced.

In prior art high-voltage fuses; the cores are typically made of mica, or of a ceramic material that may not have gas-evolving properties. These cores typically have a transverse cross-section in the shape of a star, i.e., with a centrally located trunk and a plurality of legs projecting from the trunk, with recesses between the legs, as is illustrated, for example, in U.S. Pat. No. 4,028,655 to Koch et al. One reason for using this core configuration is so as to lengthen the creepage distances along the core surface between the turns of the fusible element(s). In the manufacture of such fuses, the fusible elements are helically wound about the star-shaped core, and the resulting assembly is inserted into the tubular housing. The housing is then filled with particulate matter, typically silica sand, which is densely packed about the core-fusible element assembly and also in the recesses between the core legs and the fusible elements. To assist in packing the sand with the desired high degree of density, the fuse is typically vibrated during and after being filled with the sand. The star shape of the core makes it difficult to achieve the desired high density of the fill since vibration for a long period of time is needed to achieve a dense pack of sand in the recesses between the core legs and the fusible elements.

The performance of such a fuse depends in part upon the sand fill being held in close proximity to the location of the fusible elements since the arc or arcs formed upon operation of the fuse need to quickly react with and to be effectively quenched by the surrounding sand in order for the fuse to effect the desired current-limiting action. In the typical prior art fuse, this close proximity between the sand and the fusible element(s) is achieved by densely packing with sand the otherwise vacant spaces about the fusible element(s), including the recesses between the core legs. In view of the difficulties involved in packing these recesses with the sand fill, it would be highly desirable if the close proximity required between the sand and the fusible elements(s) could be achieved without the need for providing such recesses in the core for receiving the sand fill.

A cylindrical sand core has been shown to facilitate dense packing of the filler material to thereby improve the consistency of manufacture and the anti-arcing properties of the resulting fuses. A fuse comprising such a sand core has been described in U.S. Pat. No. 5,670,926 to Ranjan et al, which shares common inventorship with the present invention.

One disadvantage of the prior art is that high-precision assembly techniques and/or intensive manual labor have been required to consistently locate the fusible element centrally within the filler material in order to reduce undesirable arcing. The high precision techniques and manual labor each lead to increased manufacturing costs when done properly, or unreliable arcing within the fuses in some other instances.

U.S. Pat. No. 4,506,249 to Huber shows a method for terminating the fuse element in a current-limiting fuse. This teaching is directed to supporting a mica core and a method for terminating the corresponding fuse elements. Unfortunately, a sand core is heavier than a mica core and requires different types of element terminations and connections.

BRIEF SUMMARY OF THE INVENTION

In an exemplary embodiment of the invention, the above-discussed and other drawbacks and deficiencies are overcome or alleviated by a fuse having an elongated housing, an auto-centering connector centrally located about the elongated axis of the housing, and an elongated fusible element attached to the connector and secured along the elongated axis of the housing by the connector.

The auto-centering connector is located about the elongated axis of the housing by a surface near one end of the housing, and the elongated conductive fusible element is connected to the connector and contained within the housing. The auto-centering connector is connected to an end of the fusible element, and mechanically located but electrically insulated relative to the housing.

These and other features and advantages of the present invention will be appreciated and understood by those skilled in the art from the following detailed description and drawings.

BRIEF DESCRIPTION OF THE DRAWINGS

Referring to the exemplary drawings wherein like elements are numbered alike in the several Figures.

DETAILED DESCRIPTION OF THE INVENTION

Figure 1:
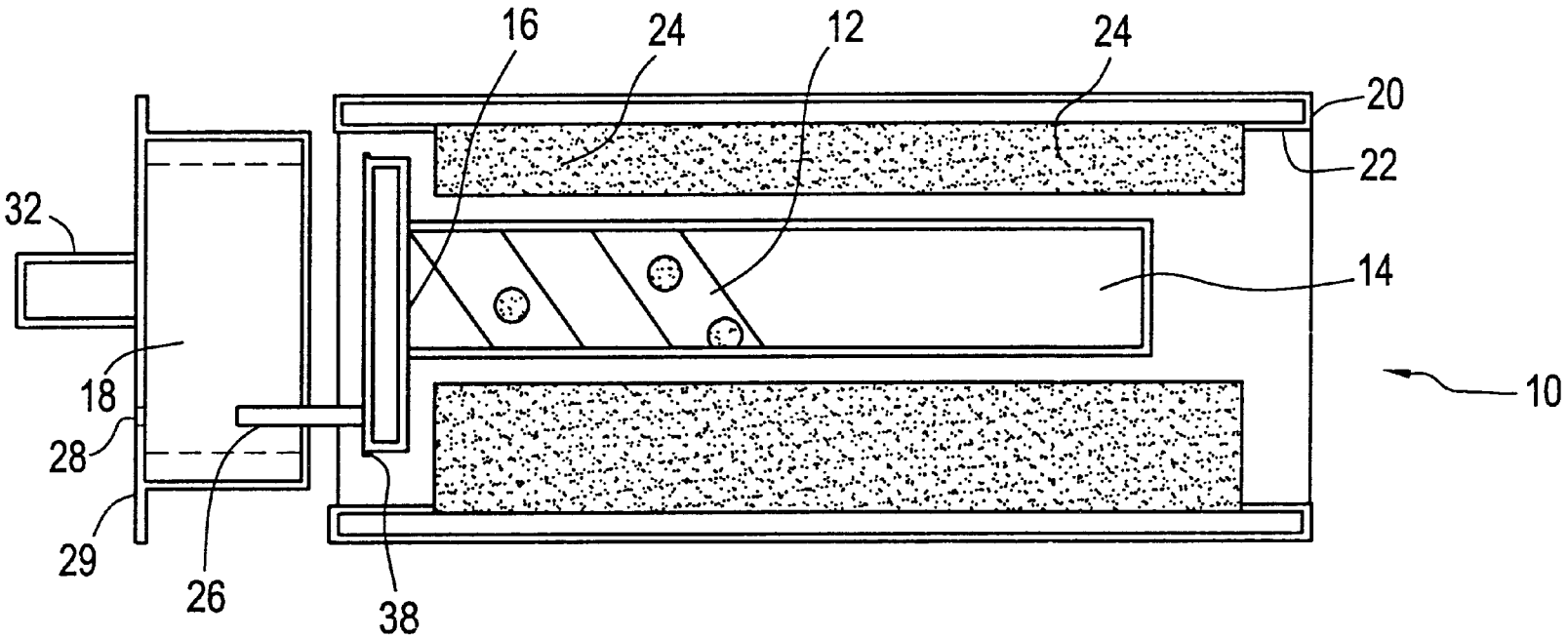
FIG. 1 is a cross-sectional view of a fuse of the present invention.

Referring to FIG. 1, an exemplary embodiment fuse of the present invention is indicated generally by the reference numeral 10. A substantially non-conductive sand core 14 supports an elongated conductive metallic fusible element 12. An auto-centering connector 16 is molded into each end of the sand core 14, but shown at only one end for illustrative purposes. Each connector has two tabs 38 extending radially from its edges. A formed metal end-enclosure 18 having a sealing lip 29 extending radially about its outermost face is adhesively connected to each of the auto-centering connectors 16. The sand core 14 extends longitudinally within a tubular housing 20 having an inner surface 22. The annular volume between the sand core 14 and the inner surface 22 is densely packed with filler 24. Any void appearing in the drawing between the sand core 14 and the filler 24 is merely an illustrative artifact, as is any dissymmetry about the longitudinal axis of the housing 20.

The elongated fusible element 12 is preferably an elongated metallic ribbon or wire. The sand core 14 is used for supporting the elongated fusible element 12 along a first surface of the element 12. The auto-centering connector 16 is connected to the fusible element 12 at each end of the sand core 14. This assembly is housed in the tubular housing 20, and the metal-formed end enclosures 18 are attached at each end of the tubular housing 20. The auto-centering connectors 16 are axially located within the tubular housing during assembly by the inner diameters of the end enclosures 18 causing the tabs 38 to compress slightly to force the auto-centering connectors 16 into a position generally aligned along the elongated axis of the housing 20. The electrical leads 26 from the connectors 16 initially extend through holes 28 in the end-enclosures 18, and the filler 24 is inserted into the tube 20 through these holes 28. The electrical leads 26 are soldered to the end enclosures 18 at the edges of the holes 28, the electrical leads 26 may then be trimmed flush if necessary, and the holes 28 are plugged to form a substantially airtight seal.

The fuse core 14 itself is made of a material that is primarily silica sand, the particles of which are bonded together to form a rigid but porous mass. Before the core 14 is formed, the silica sand that is subsequently used for the core is mixed with bonding agents, preferably kaolin clay and colloidal silica or a sodium silicate solution. The resulting mixture is suitably shaped, following which it is baked into a rigid mass of elongated configuration that is used for the core 14. The auto-centering connectors 16 are moldedly attached at opposite ends of the elongated rigid mass 14, and one or more fusible elements 12 are wound about the mass 14 and connected between the connector assemblies 16.

The sand core 14 is molded integrally onto two auto-centering connectors 16, one at each end. The perforated ribbon fusible element 12 is spiral-wound around the sand core 14 with an inter-coil spacing sufficient to maintain a substantially non-conductive gap between the wound coils of the fusible element 12. The ends of the fusible element 12 are then welded to the auto-centering connectors 16. The assembly is then placed inside the tubular housing 20. The first metal-formed end enclosure 18 is then placed at a first end of the tubular housing 20 with a first electrical lead 26 protruding through a hole 28. A lip 29 of the first end enclosure has an outer diameter equal to the outer diameter of the first end of the housing 20. The first end enclosure 18 is then adhesively bonded to the tubular housing 20 with an epoxy. The electrical lead 26 from the connector 16 is brought out through a hole 28 in each end enclosure 18. The tubular housing 20 is filled with the filler 24 through the hole 28 in the second end while permitting the displaced gas to vent from the hole 28 in the first end. The edges of the holes 28 are then soldered to the electrical leads 26 and plugged to provide a substantially airtight seal. The plug may comprise any of a number of conventional objects or materials, such as, for example, solder or a lead cylinder adhesively bonded to the end enclosure 18.

In this exemplary embodiment, the rigid mass forming the core 14 is of cylindrical shape and has a substantially circular transverse cross-section. The helically wound fusible element 12 closely surrounds the periphery of the circular cross-sectional core 14. The core 14 has a periphery that is generally smooth apart from the roughness resulting from the presence of projecting silica sand particles; although it is to be understood that the core periphery of an alternate embodiment has helical indentations into which the fusible element 12 seats.

This assembly is housed by the tubular housing 20, and metal-formed end enclosures 18 are attached at each end of the tubular housing 20. The auto-centering connectors 16 are axially located within the tubular housing 20 during assembly by the inner diameters of the end enclosures 18. Electrical leads 26 from the connectors 16 extend through holes 28 in the end-enclosures 18, and the filler 24 is inserted into the tube 20 through these holes 28. The electrical leads 26 are soldered to the end enclosures 18 and the holes 28 are plugged to form a substantially airtight seal.

Each end enclosure 18 has a welded terminal 32 to accept a standard electrical connection, such as for example a ¼×20 fastener. This connection could take other forms, such as for example a spade or a stud welded or fastened anywhere on the enclosure and not necessarily positioned in the center as shown. A hole 28 is drilled for bringing out the electrical connection as well as to allow for filling the housing 20 with filler 24. The end enclosures 18 are made of copper and are metal formed.

The materials and configuration of the fusible element 12 are selected to meet a particular current limit target. In operation, when the current flow through the fuse 10 reaches the range of the current limit target, the temperature of at least one portion of the fusible element 12 will approach the melting point of the fusible element material and then melt to thereby protect the conductors, insulation, and other components of the protected circuit from the excessive current, without internal arcing of the fuse 10.

Figure 3:
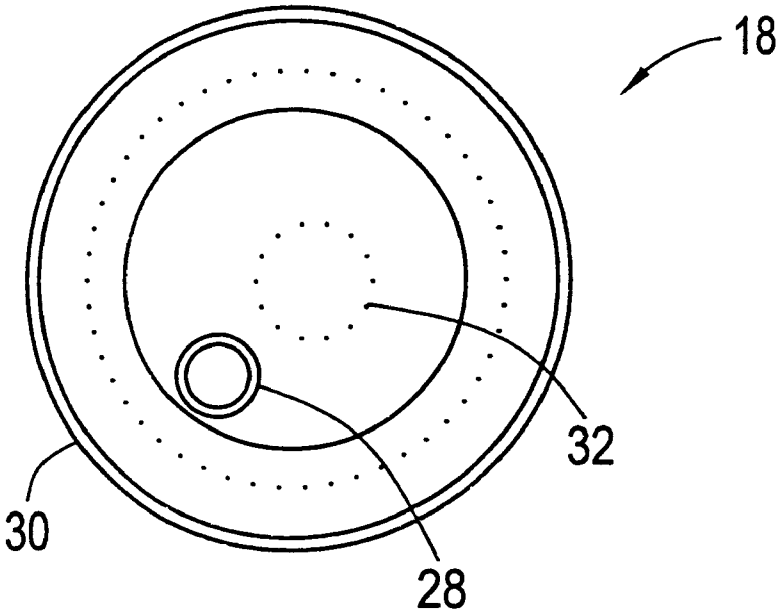
FIG. 3 is an elevational front view of the end enclosure of FIG. 1.
Figure 2:
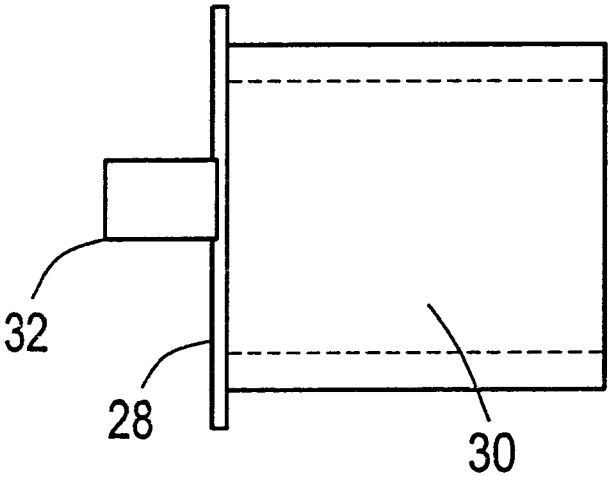
FIG. 2 is an elevational side view of the end enclosure of FIG. 1.

Turning to FIGS. 2 and 3, the end enclosure 18 of FIG. 1 is shown in greater detail. The section 30 has an outside diameter to fit inside the tubular housing 20 where it is glued with epoxy. The inside diameter is large enough to accommodate the auto-centering connector 16 and maintain the core 14 in the center of the end enclosure 18 and, in turn, in the axial center of the housing 20.

Figure 5:
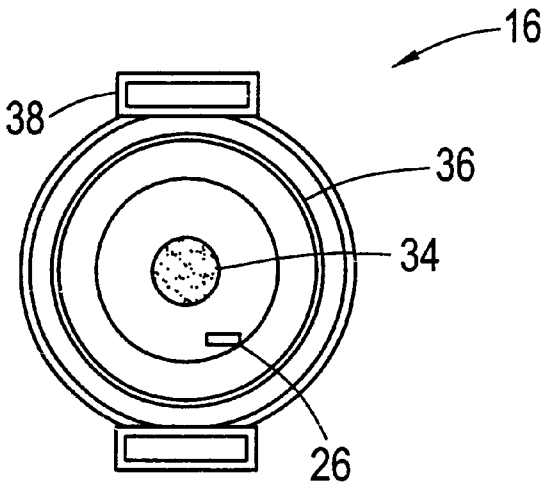
FIG. 5 is an elevational front view of the auto-centering connector of FIG. 1.
Figure 4:
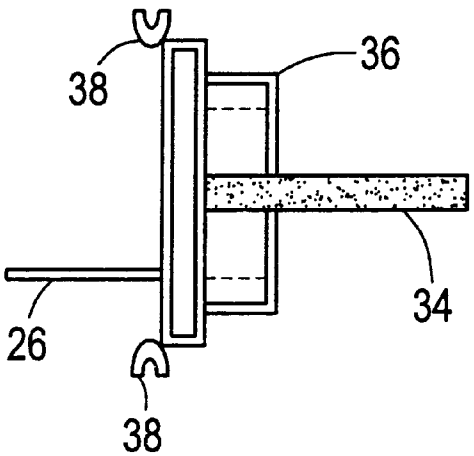
FIG. 4 is an elevational side view of the auto-centering connector of FIG. 1.

Turning now to FIGS. 4 and 5, the auto-centering connector 16 of FIG. 1 is shown in greater detail. The auto-centering connector 16 has a pin 34 for insertion into the sand core 14 during the core molding process, and an element terminal 36 for welding to the fusible element 12. The element terminal 36 preferably has the same outer diameter as the sand core 14 to facilitate the welding of the element 12 during the winding process. The auto-centering feature is provided by the tabs 38, which extend radially from the connector 16, and may be bent at their outermost ends to provide a localized spring action for a centered alignment along the longitudinal axis of the housing 20. The tabs have a flat outer edge as shown in FIG. 5, but may also have a convex outer edge to more closely conform to the inner wall of the housing 20 or end enclosure 18. Each spring tab 38 is partially compressed between the inner wall of the housing 20 or end enclosure 18 and its attachment to the body of the connector 16. The two tabs shown are spaced 180 degrees from each other about the circumference of the connector 16. Thus, the spring forces applied by each tab 38 are directed towards the axial center of the connector 16, where they cancel each other out, and the auto-centering connector 16 is thereby positively located concentrically along the elongated axis of the housing 20. Although two tabs are shown for illustrative purposes, any whole number of equivalent tabs may be used as long as they are preferably distributed about the circumference of the connector 16 in a symmetrical manner, and not necessarily an equidistant manner.

The electrical lead 26 is connected to the element terminal 36. The electrical lead 26 is a flat piece of copper in this exemplary embodiment, although it may also take the form of a braid of wire, or be made of other materials suitable for conducting electric current, such as for example, aluminum, silver, gold or tin. Any of these parts can be joined to each other by welding, soldering, or other process suitable for making an electrical connection. Alternatively they can be integrally metal formed by other suitable manufacturing processes.

Figure 6:
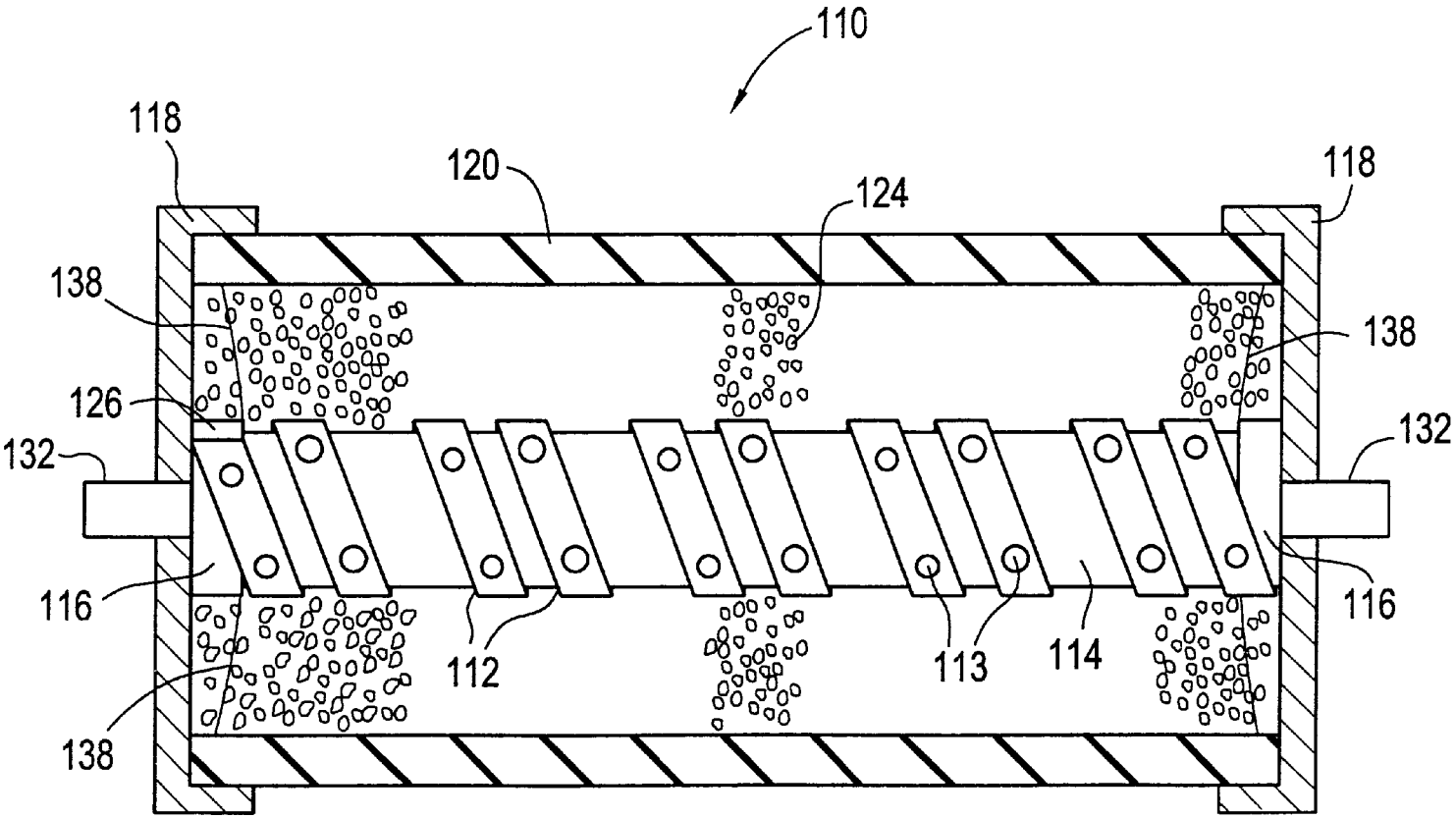
FIG. 6 is an elevational view of a second embodiment of a fuse of the present invention.

In FIG. 6, a second exemplary embodiment fuse of the present invention is indicated generally by the reference numeral 110. The second exemplary embodiment is similar to the first exemplary embodiment of FIGS. 1–5. Accordingly, like numbered reference numerals preceded by the number "1"will be used to indicate like features. The fuse 110 comprises an elongated core 114 of an electrical insulating material, two fusible elements 112 helically wound about the core 114, and auto-centering connectors 116, each having electrical leads 126, fixed to the core 114 at its opposite ends. The fusible elements 112 are electrically connected at their opposite ends to the electrical leads 126 of the auto-centering connectors 116 by suitable means such as soldered or welded joints. A completed fuse includes an outer tubular housing 120, which encases the above components and filler 124 of particulate matter occupying the space between the core 114 and the housing 120. The fuse also includes end enclosures 118 mounted on opposite ends of the tubular housing 120, having externally projecting conductive terminals 132 that are suitably electrically connected to the electrical leads 126 of the auto-centering connectors 116 immediately adjacent to the respective conductive terminals 132.

The filler 124 in the volume between the core 114 and the outer tubular housing 120 is silica sand, but may alternately be comprised of other non-conductive particulate matter such as ceramic grains. The silica sand filler is densely packed sand with no bonding between its particles, but may alternately be comprised of sand with its particles bonded together as known to those skilled in the pertinent art.

The core 114 is made of a mixture including as its primary constituent pure silica sand of the type conventionally used in the fill of current-limiting fuses, and, to a much lesser extent, finer grain silica filler, kaolin clay, and a binder of colloidal silica or a sodium silicate solution. If a colloidal silica solution is used, the dispersion medium may be water, kerosene, ether, or some other suitable liquid. In one alternate embodiment of the invention, the following mixture can be used to make a 1-inch diameter cylindrical core 15 inches in length: Pure silica sand 400 grams; Fine grain silica 50 grams; Kaolin clay 50 grams; Colloidal silica 80 cc. After these components are thoroughly mixed together, the resulting wet mixture is introduced into a sand core box having a mold cavity corresponding to the desired cylindrical shape of the core, the auto-centering connectors 116 having previously been disposed at opposite ends of the mold cavity. The introduced mixture fills the mold cavity and the auto-centering connectors 116, forming a cylindrically shaped uncured core on the ends of which the auto-centering connectors are mounted. The resulting core assembly is then air dried, following which it is baked at an appropriate temperature (e.g., about 140 degrees C.) for 4 to 6 hours to convert the uncured core into a rigid mass in the shape of the cylindrical fuse core 114 having the auto-centering connectors 116 bonded to its opposite ends.

While a molding process such as described above is one way of forming the fuse core, other processes are also suitable, such as, for example, extrusion. In such a process a wet mixture corresponding to the above-described mixture is extruded through a suitably shaped die to produce a long extrusion of the desired transverse cross-section. The long extrusion is then cut to the desired length to form the core element, following which the auto-centering connectors 116 are applied to the core 114. Then this subassembly is air dried and then baked to convert the uncured core into a rigid mass having the auto-centering connectors fixed in place.

After the core 114 is formed with the auto-centering connectors 116 fixed in place by one of the above or other suitable processes, the fusible elements 112 are helically wound on the core and their ends attached to the end connector assemblies. Two fusible elements 112 electrically in parallel are shown wound about the core, but, depending upon the current rating of the fuse, a single fusible element or more than two elements may be used, each being helically wound about the core. The fusible elements 112 can be of a common fusible metal, such as copper, aluminum, or silver. Each of the fusible elements 112 can be of a conventional form, e.g., in the form of a ribbon, such as shown, which contains holes 113 at spaced locations along its length defining regions of reduced cross-section where an arc can be initiated in response to a fault current through the fusible element. The fusible elements can also be of wire form instead of the ribbon form shown, or other elongated form.

The peripheral surface of the sand core 114, although smooth on a gross basis, has a rough texture, and this roughness assists in holding the fusible elements in place on the core against displacing forces such as those developed during subsequent filling of the casing 120 with sand and also during an electrical interruption operation. The rough sand surface also has a high resistance to arc tracking, and this decreases the likelihood that an arc will develop on the core surface between the turns of the fusible element or elements during an interruption operation. An arc between the turns is undesirable because it typically will short across a length of the fusible element and any fused portions that might be present in such length.

After the core with attached fusible elements is produced in the above or equivalent manner, it is introduced into the tubular insulating housing 120. The spring tabs 138 of the auto-centering connectors 116 automatically center the core 114 and fusible elements 112 axially within the elongated tubular housing 120. It is to be noted that in this alternate exemplary embodiment, the auto-centering connectors are centered directly by the inner surface of the housing 120, rather than by the inner surfaces of the end enclosures as in the previously described exemplary embodiment of FIGS. 1–5. One of the end enclosures 118 is applied to the first end of the housing 120 and suitably connected to the first electrical lead 126, following which the space between the core with attached fusible elements and the housing 120 is filled with particulate matter filler 124, such as silica sand. Thereafter, the other end enclosure 118 is applied to the second end of the housing 120 and is suitably electrically connected to the second electrical lead 126. If the sand fill 124 is to be of the bonded type of sand, it can be treated with suitable bonding material before being used to fill the housing 120 or it can be treated with liquid bonding material after filling the otherwise-vacant space within the housing 120, as known to those skilled in the pertinent art. After the sand is in place, the fuse assembly is suitably heated to drive off moisture and to complete the sand-bonding process where the bonded type of sand is being used.

In the sand core composition described herein, the fine-grain silica sand additive acts as filler, its particles being located between the larger particles of the major silica sand component and serving to control the porosity of the mixture. The kaolin clay acts as a bonding agent for the mixture, imparting increased mechanical strength to the core, and also contributes to the current-interrupting properties of the mixture by evolving water vapor during arcing in response to the heat of the arc. The colloidal silica is primarily a bonding agent that binds together the particles of the mixture. When the core is air-dried and baked before its introduction into the fuse, the water in the colloidal silica is evaporated. Left behind on the particles of the mixture is a thin coating of the silica from the colloidal suspension, which serves to bind together these particles. This coating is so thin that it does not substantially affect the porosity of the final core.

It is to be noted that having a core of cylindrical shape may make it easier to achieve the desired intimate contact between the sand fill and the exposed surfaces of the fusible element. There are no recesses underneath the fusible element, as present with a core of star configuration as known to those skilled in the pertinent art, which must be tightly packed in order to achieve such intimate contact. Accordingly, although a cylindrical core is currently preferred to a star shaped core, the teachings of the present invention are not limited to use with a cylindrical core, and may be applied to non-cylindrical core embodiments without exceeding the scope or spirit of the present invention.

It is to be further noted that the circular outer periphery of the cylindrical core is a preferred configuration for maximizing the spacing between the turns of a helical fusible element of a given length wound on a core of a given length and diameter. With a conventional star-shaped core, the fusible element wound about the core typically follows a straight-line path in its portions spanning the recesses that are disposed between the legs of the star, thus shortening the effective circumference of the star-shaped core. To compensate for this shortening that is present with the star-shaped core, it is necessary with a star-shaped core and a fusible element of given lengths to locate the turns of the helically wound fusible element closer together in order to squeeze into the fuse a helically-wound fusible element of this length.

The illustrated fuse operates in generally the same manner as conventional current-limiting fuses. That is, when an over current or a fault current flows through the fusible elements 112, the fusible elements 112 melt and then vaporize at preselected locations along their length, usually beginning where the holes 113 are located, causing arcs to develop at these locations. The arcs react with the surrounding sand fill 124 and develop pressures in the arcing region that produce arc voltages that force the current to zero. The pressurized metallic vapors generated when the arcs vaporize portions of the fusible elements 112 tend to expand away from the arcing regions.

The porous character of the surrounding sand fill 124 enables the hot and expanding metallic vapors to be quickly dissipated from the arcing regions, thus quenching the hot vapors, limiting the pressures built up, and thereby facilitating successful electrical interruption. The core 114 itself has some porosity, and this effectively contributes to rapid dissipation and quenching of the metallic vapors developed by the arcs.

While the core 114 has some porosity, it is sufficiently hard and resistant to arc-erosion that its regions immediately adjacent the fusible elements 112 normally do not move substantially during arcing. Such movement is usually undesirable because it would allow the channel normally occupied by the fusible elements 112 to expand, and this would detract from the interrupting ability of the fuse 110.

As will be recognized by those skilled in the pertinent art based on the teachings herein, although a cylindrical fuse is shown, the use of other shapes, as well as other suitable types of materials having properties comparable to those listed herein for meeting the requirements of the present disclosure are within the scope and spirit of the present invention.

When a short circuit condition occurs at a high level of current within the protected circuit (i.e., above the rated current of the fuse), the fusible elements 12 or 112 will melt to thereby stop the flow of current in order to prevent damage to the protected circuit, such as would be caused by overheating.

As may be recognized by those skilled in the pertinent art based on the teachings herein, the innermost annular edge of the end enclosures may be beveled to ease insertion over the outer surface of the auto-centering connectors.

Advantageously, the present invention does not require a precision jig for locating the auto-centering connectors, nor does it require manual centering of the connectors or the attached core within the fuse housing. Thus, a fuse embodying the present invention may be manufactured more economically than prior art fuses of equivalent service rating while maximizing their anti-arcing properties.

Another advantage of the present invention is that the filler material will still pass around the auto-centering connectors substantially unimpeded in order to substantially fill all voids within the fuse housing.

Another advantage of the present invention is that the minor outside diameter of the auto-centering connector may be equal to the outside diameter of the core in order to facilitate application of the fusible element and subsequent filling of the fuse assembly.

A further advantage of the present invention is that the auto-centering connectors become automatically centered within the fuse housing during assembly in order to maximize the distance that an arc must travel to reach a critical component such as the fuse housing or an end enclosure.

Another advantage of the present invention is that the long travel of an arc through the sand core will tend to dissipate the arc so that there will be insufficient energy left to damage an end housing and break the seal of the fuse.

Another advantage of the present invention is that the electrical leads from the auto-centering connectors may be soldered or resistance-welded to the end enclosures in order to allow these leads to better dissipate the heat generated from excessive current and thereby prevent them from melting and destroying the integrity of the air-tight seal of the fuse.

One more advantage of the present invention is that the sealed fuse will tend to produce vapors from the melting of the fusible element and the dissipation of arcs within the filler that will further prevent arcing within the fuse.

An additional advantage of the present invention is that the auto-centering connectors comprise bent edges that facilitate insertion of the end enclosures while additionally providing a measure of mechanical retention of the end enclosures to thereby strengthen the integrity of the fuse assembly.

Additional advantages of the present invention may be recognized by those skilled in the pertinent art, based on the teachings herein.

While the invention has been described with reference to exemplary embodiments, it will be understood by those of ordinary skill in the pertinent art that various changes may be made and equivalents may be substituted for the elements thereof without departing from the scope or spirit of the present invention. In addition, many modifications may be made to adapt a particular configuration or material to the teachings of the invention without departing from the essential scope thereof. Therefore, it is intended that the invention not be limited to the particular embodiments disclosed as exemplary modes contemplated for carrying out this invention, but that the invention will include all embodiments falling within the scope of the appended claims.

What is claimed is:

1. A fuse comprising:

an elongated housing;

an auto-centering connector axially located within the housing;

at least one fusible element having one end electrically coupled to the auto-centering connector and located along the elongated axis of the housing by the auto-centering connector; and an end enclosure having a feedthrough, said end enclosure coupled to a first end of the housing and coupled in electrical communication to said at least one fusible element via an electrical lead extending through said feedthrough of said end enclosure from said auto-centering connector.

2. The fuse of claim 1 further comprising a plurality of fusible elements coupled in electrical communication to said end enclosure via said electrical lead extending through said feedthrough of said end enclosure.

3. The fuse of claim 1 further comprising an elongated core coupled to the auto-centering connector.

4. The fuse of claim 3 wherein the at least one fusible element includes a surface defining a length of said at least one fusible element, said surface is in continuous contact with the core along said length of said at least one fusible element.

5. The fuse of claim 3 wherein the core is cylindrical.

6. The fuse of claim 1 wherein the end enclosure is adhesively bonded to the housing with epoxy.

7. The fuse of claim 1 wherein the electrical lead is coupled to the end enclosure within the feedthrough.

8. The fuse of claim 1 further comprising a plug sealably engaged in the feedthrough.

9. The fuse of claim 1 wherein the at least one fusible element comprises metal.

10. The fuse of claim 1 wherein the at least one fusible element comprises a perforated ribbon.

11. The fuse of claim 3 wherein the at least one fusible element is helically wound about the core.

12. The fuse of claim 1 wherein the auto-centering connector comprises at least one spring tab.

13. The fuse of claim 12 wherein the at least one spring tab is bent at an outer end.

14. The fuse of claim 11, wherein a periphery surface defining the core is configured to receive the at least one fusible element defining a flush periphery surface of the core having the helically wound at least one fusible element.

15. A method of manufacturing a fuse, the method comprising:

providing an elongated housing;

configuring an auto-centering connector for axial location within the housing;

coupling a core to said auto-centering connector;

winding at least one fusible element about said core;

electrically coupling one end of said at least one fusible element to the auto-centering connector;

coupling an end enclosure to a first end and along the elongated axis of the housing by the auto-centering connector; and electrically coupling said end enclosure having a feedthrough to said at least one fusible element via an electrical lead extending from said auto-centering connector through said feedthrough of said end enclosure.

16. The method of claim 15 further comprising coupling a plurality of fusible elements in electrical communication to said end enclosure via said electrical lead extending through said feedthrough of said end enclosure.

17. The method of claim 15, wherein said molding includes molding a cylindrical core.

18. The method of claim 15 wherein the electrical lead is coupled to the end enclosure within the feedthrough.

19. The method of claim 15 further comprising engaging a plug sealably in the feedthrough.

20. The method of claim 15 wherein the auto-centering connector comprises at least One spring tab.

21. The method of claim 20 wherein the at least one spring tab is bent at an outer end.

* * * * *